United States Patent [19]

Masujima

[11] Patent Number: 4,978,967

[45] Date of Patent: Dec. 18, 1990

[54] OFFSET ANTENNA

[75] Inventor: Toshio Masujima, Kanagawa, Japan

[73] Assignee: Mitsubishi Denki Kabushiki Kaisha, Tokyo, Japan

[21] Appl. No.: 155,605

[22] Filed: Feb. 12, 1988

[30] Foreign Application Priority Data

| | | | |
|---|---|---|---|
| Feb. 13, 1987 | [JP] | Japan | 62-19537[U] |
| Feb. 16, 1987 | [JP] | Japan | 62-20989[U] |
| Aug. 18, 1987 | [JP] | Japan | 62-204316 |
| Nov. 25, 1987 | [JP] | Japan | 62-296616 |

[51] Int. Cl.[5] ..... H01Q 19/13

[52] U.S. Cl. ..... 343/781 R; 343/781 P; 343/837

[58] Field of Search ..... 343/781 R, 781 P, 781 CA, 343/786, 840, 837

[56] References Cited

U.S. PATENT DOCUMENTS

| | | | |
|---|---|---|---|
| 4,012,743 | 3/1977 | Maciejewski | 343/781 R |
| 4,410,892 | 4/1977 | Knop et al. | 343/781 R |
| 4,607,260 | 8/1986 | Dragone | 343/786 |

FOREIGN PATENT DOCUMENTS

| | | | |
|---|---|---|---|
| 3224257 | 12/1983 | Fed. Rep. of Germany | 343/781 CA |

OTHER PUBLICATIONS

Japanese Utility Model Publication Nos. 27609/1985 and 12996/1975.

Japanese Patent Publication No. 31345/1978.

*Primary Examiner*—Michael C. Wimer

*Attorney, Agent, or Firm*—Wolf, Greenfield & Sacks

[57] ABSTRACT

An offset antenna having a reflector of a paraboloid of revolution and a side plate surrounding the periphery of the reflector, wherein a primary radiator is disposed within the cylindrical side plate.

18 Claims, 8 Drawing Sheets

OFFSET ANTENNA

BACKGROUND OF THE INVENTION:

1. Field of the Invention

The present invention generally relates to an aperture antenna for use in microwave band communication, radar, or the like and, more particularly, to the improvement of an offset antenna having a circular aperture.

2. Description of the Prior Art

A conventional offset antenna has such a structure as that disclosed in, e.g., Japanese Utility Model Unexamined Publication No. 27609/84. FIG. 1 is a side elevational view showing such conventional offset antenna, FIG. 2 is a front view thereof, and FIG. 3 is a partial perspective view. In FIGS. 1 to 3, a reflecting mirror 1 has a shape which is obtained by cutting with a plane P a paraboloid of revolution in which a focal point is set to F and a rotary axis is set to A—A, the plane P being inclined at an angle of $\phi$ to the rotary axis A—A. A primary radiator 2 consists of, e.g., a conical horn. The center of the phase of the radiation radio wave of the primary radiator 2 coincides with the focal point F of the reflecting mirror 1. A cylindrical side plate 3 is disposed around the reflecting mirror 1. A cut portion 4 is formed at the bottom of the side plate 3 as shown in FIG. 3. The hole 4 is covered by a box 5. An edge 8 is formed in the coupling portion of the side plate 3 and box 5. The primary radiator 2 is disposed in the box 5. The reflecting mirror 1 is attached to the aperture on one side of the side plate 3. The radio waves radiated from the primary radiator 2 are reflected by the reflecting mirror 1 and transmitted along a transmission path 7. The aperture of the side plate 3 through which the radio waves are emitted is covered by a radome 6 made of a dielectric material.

The conventional offset antenna is constituted in the manner explained above. When considering this antenna as a transmission antenna, the radio waves which are radiated from the primary radiator 2 are transmitted as shown by the transmission path 7. Namely, they are radiated as spherical waves whose centers are located at the center of the radiation radio wave phase of the primary radiator 2, i.e., at the focal point F. These radio waves are reflected by the reflecting mirror 1 and converted into plane waves, thereby forming a sharp beam in the forward direction of the antenna. When rain droplets or snow is deposited on the aperture of the primary radiator 2 the amplitude distribution and phase distribution of the radio waves radiated from the primary radiator 2 change, so that the inherent sharpness of the beam deteriorates and the radio waves are reflected in inappropriate directions. To avoid such problems, the radome 6 has a sealed structure together with the reflecting mirror 1, side plate 3 and box 5, thereby preventing rain or snow from entering the inside of the box and being deposited on the primary radiator 2. Further, the hole 4 of the side plate 3 is arranged so as not to block the radio waves propagating along the transmission path 7 from the primary radiator 2 to the forward direction of the antenna through the reflecting mirror 1. The radome 6 is also formed of a thin dielectric film which is thin enough in comparison with the wave length to minimize the reflection of the radio waves when they pass through the radome 6.

According to the offset antenna constituted in consideration of the foregoing points, deterioration in side lobe and reduction in gain due to blocking do not occur, unlike the parabolic antenna or Cassegrain antenna in which blocking is inherently experienced. Therefore, such an offset antenna has good characteristics and may be used for high density communications or satellite communications.

However, with respect to the hole 4 of the side plate 3 which is necessary in such conventional offset antennas, there are a few problems to be considered in terms of electrical characteristics and mechanical strength.

First, as for the electrical characteristics, when the hole 4 is considered from the viewpoint of geometrical optics, it is sufficient to form the hole with a shape corresponding to a intersecting line formed by cutting with the side plate 3 a circular cone which is generated by selecting the focal point F and the periphery of the reflecting mirror 1 as a vertex and a generating line, respectively. However, in practice, since the wavelength of radio waves is a few centimeters and the circular cone formed by the radio waves has a wave-like extension, the hole 4 must be larger than the intersecting line. In particular, the hole 4 needs to be formed with a sufficient size near the primary radiator 2. In practical use, as shown in FIG. 3, the hole 4 is generally formed so as to have substantially the same size as the box 5. Further, the hole 4 forms an edge 8 between the hole 4 and the side plate 3 and thus has this edge 8, as well as the outer periphery of the reflecting mirror 1, the periphery being an inherent edge of the antenna. The deterioration in side lobe characteristics increases due to edge diffraction or edge scattering. Therefore, it is necessary to attach a radio wave absorbing material or the like to the antenna.

Next, in regard to mechanical strength, the continuity of the side plate 3 as a cylindrical shell is interrupted by the hole 4. Further, at the portion where the side plate 3 and box 5 are coupled, the curvature of the shell and its direction suddenly change, so that an out-of-plane bending moment is generated in this portion. Therefore, countermeasures need to be taken, for example, to increase the thickness of the plate or to reinforce this portion. On the other hand, when the antenna is exposed to a strong wind such as are experienced in typhoons or the like, the box 5 disturbs the wind currents and increases the wind load. It is therefore necessary to construct a shape adapted to reduce the influence played by the wind on the basis of experiments using a wind tunnel or the like so as to reduce wind disturbance and to improve the strength of each section on the basis of the results of such experiments.

These are not the critical problems experienced with an offset antenna and the relevant countermeasures are taken to prevent deterioration in the inherent electrical and mechanical characteristics of the offset antenna. However, in order to improve those characteristics a radio wave absorbing material needs to be used, the plate thickness needs to be increased, and so forth, which means that the bulk of the antenna is increased. Further, with respect to the shape of the hole, the position at which the radio wave absorbing material is attached and the shape and selection of the box need to be determined by developing a procedure that utilizes significant experimental factors. This makes it difficult for a cheap offset antenna having good characteristics to be realized.

A second example of the conventional offset antenna is shown in, e.g., Japanese Patent Publication No. 31345/78. FIG. 4 is a side elevational view showing such an offset antenna and the front view and a partial perspective view thereof are as shown in FIGS. 2 and 3 (except that $F_2$ is used in place of F shown in FIG. 2).

In these diagrams, the main reflecting mirror 1 has a shape which is obtained by cutting with a plane P a paraboloid of revolution in which the focal point is set to $F_2$ and the rotary axis is set to A—A, the plane P being inclined at an angle of $\phi$ relative to the rotary axis A—A. A subreflecting mirror 9 has a shape constituting a part of an ellipsoid of revolution in which the conjugate focal points are set to $F_1$ and $F_2$ and the rotary axis is set to B—B. The phase center of the radiation radio wave from the primary radiator 2 coincides with $F_1$ as one of the focal points of the sub-reflecting mirror 9. The primary radiator 2 consists of, e.g., a conical horn. The other compositional elements are similar to those employed in the offset antenna of the first conventional example which was described above with reference to FIGS. 1 to 3. When the offset antenna shown in FIG. 4 is used as a transmission antenna, the radio waves radiated from the primary radiator 2 are transmitted along the transmission path 7. Namely, the radio waves are radiated as spherical waves whose centers are located at the phase center of the radiation radio wave from the radiator 2, i.e., at the focal point $F_1$. These radio waves are reflected by the sub-reflecting mirror 9 and transmitted via the focal point $F_2$. Then, they are reflected by the main reflecting mirror 1 and converted into plane waves, thereby forming a sharp beam at a position in the formed direction of the antenna. Since the offset antenna in the second conventional example operates in a manner similar to the first conventional example, those with ordinary skill in the art will readily understand it without the need for further description.

There are thus problems to be considered in terms of the foregoing electrical characteristics and mechanical strength, similar to the case of the first conventional example.

SUMMARY OF THE INVENTION:

It is, further, an object of the present invention to solve the foregoing problems and to provide a cheap offset antenna which is free from any tendency to suffer from deterioration of the electrical and mechanical characteristics.

According to the invention, in order to accomplish the above objects, there is provided an offset antenna in which the shape of the inner surface of a side plate is constituted by an envelope body consisting of a set of cones in which the outer periphery of a reflecting mirror is used as a generating line and each point on the outer periphery of a radome is set as a vertex, and the outer peripheral shape of the radome is formed so that a primary radiator is included in the outer peripheral shape of the radome when the radome is projected onto the aperture plane of the antenna.

Further, according to the invention, there is provided an offset antenna in which the shape of the inner surface of a side plate is constituted by a cone having its vertex on an axis which passes through the farthest point on the outer periphery of a reflecting mirror from a focal point F and which is parallel to the rotary axis of the reflecting mirror, and having the outer periphery of the reflecting mirror as a generating line, a primary radiator being included inside the side plate.

Further, according to the invention, there is provided an offset antenna in which the shape of the inner surface of a side plate is constituted by a cone using the outer periphery of a reflecting mirror as a generating line and having its vertex in a plane including a rotary axis of the reflecting mirror and having a predetermined relation with the reflecting mirror, a primary radiator being included inside the cone, i.e., the side plate.

Additionally, according to the invention, there is provided an offset antenna in which the shape of the inner surface of a side plate is constituted by a cone using the outer periphery of a main reflecting mirror as a generating line and having its vertex in the plane including a rotary axis of the main reflecting mirror and having a predetermined relation with the main reflecting mirror, a sub-reflecting mirror and a primary radiator being included inside the cone, i.e., the side plate.

With the foregoing constitution, the side plate can cover the transmission path without separating or blocking the cone formed by the radio waves which are radiated from the primary radiator. Therefore, a hole does not need to be formed in the side plate for passage of the radio waves. It is possible to eliminate deterioration in the side lobe characteristics due to the edge of the hole and lowering of the mechanical strength around the hole. Further, since the side plate in this invention also serves as the primary radiator and the box used in the prior art to cover the hole, the number of parts constituting the offset antenna can be reduced.

Figure 5:
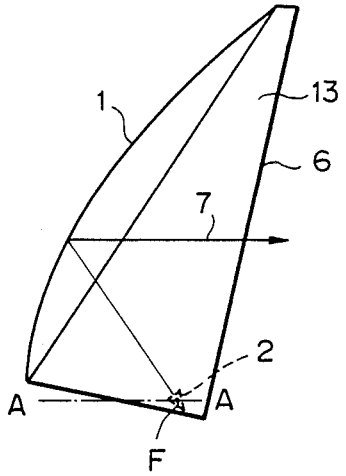
FIG. 5 is a side elevational view showing a first embodiment of an offset antenna according to the invention.
Figure 6:
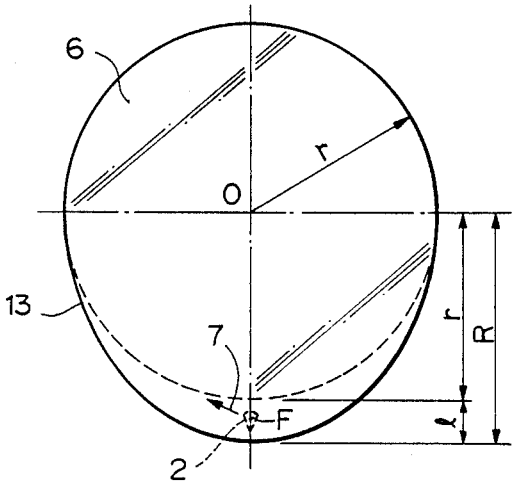
FIG. 6 is a front view of the offset antenna shown in FIG. 5.
Figure 7:
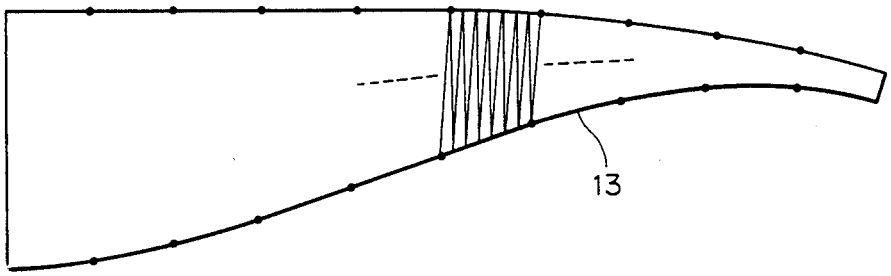
FIG. 7 is a developed view of half of a side plate 13.

DETAILED DESCRIPTION OF THE PREFERRED EMBODIMENTS:

Referring to FIGS. 5 to 7, the first embodiment of the present invention is shown in these diagrams in which a reflecting mirror (reflector) 1, a primary radiator 2, and a radome 6 are similar to those in the conventional offset antenna described above. The shape of a side plate 13 according to the invention is determined in the following manner. An elliptical cone is distinctly determined in such a manner that the outer periphery of the reflecting mirror 1 is used as a generating line and one point on the outer periphery of the radome 6 is set as a vertex. When the vertex moves on the outer periphery of the radome 6, the elliptical cones are sequentially determined in correspondence with this movement. As the vertex moves around the outer periphery of the radome 6, an envelope body is formed as a set of these cones. When the outer peripheral shape of the radome 6 is projected onto the aperture plane of the antenna, namely, when seen from the direction of the rotary axis A—A as shown in FIG. 6 the portion located above the center 0 of the aperture is formed in the outer peripheral shape of the reflecting mirror 1, i.e., as a semicircle with a radius r, and the portion located below the center 0 of the aperture is formed by setting the outer peripheral shape of the radome 6 into a semiellipse in which the dimension of the extended portion is set at l, the minor radius is set at r, and the major radius is set at $R=r+l$ whereby the primary radiator 2 is included in this lower portion. Thus, the envelope bodY is nonambiguously determined and the side plate 13 has a shape corresponding to the envelope body as its inner surface. In cases other than the case where $l=0$, i.e., where the side plate 13 is formed as a cylinder, the surface of the side plate 13 is not a curved surface which can be expanded into a flat plane. However, as shown in FIG. 7 (which illustrates half of the side plate 13), it is possible to divide the outer periphery of each of the reflecting mirror 1 and radome 6 into equal parts and to numerically approximately expand them as an accumulation of triangles having their real lengths between the respective points.

In the offset antenna constituted as mentioned above, the radio waves radiated from the primary radiator 2 to the reflecting mirror 1 are propagated along the transmission path 7 and form a sharp beam in the forward direction of the antenna in a manner similar to the conventional apparatus. However, the cone formed by the radio waves is included inside the side plate 13 and the hole and the edge formed by this hole which are present in the conventional apparatus are unnecessary. The side plate 13 does not interrupt or block the transmission path 7. Namely, the only edge which serves to deteriorate the characteristics is the outer edge which is inevitable with an antenna, i.e., the outer periphery of the reflecting mirror 1. The deterioration in side lobe characteristics due to the wave-like operation of the radio waves is thus minimized.

Figure 1:
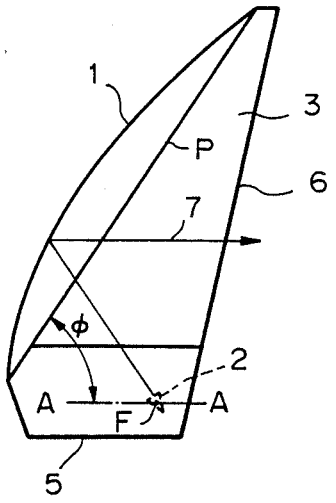
Fig. 1 (PRIOR ART)
FIG. 1 is a side elevational view of a first example of a conventional offset antenna.
Figure 2:
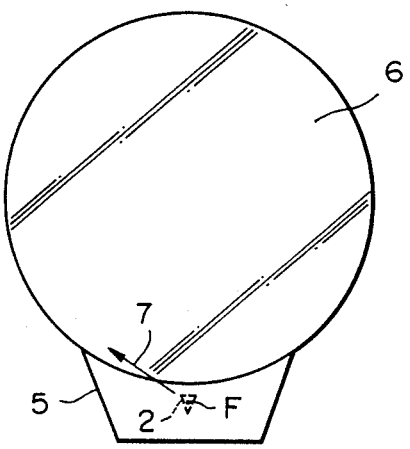
Fig. 2 (PRIOR ART)
FIG. 2 is a front view of the offset antenna shown in FIG. 1.
Figure 3:
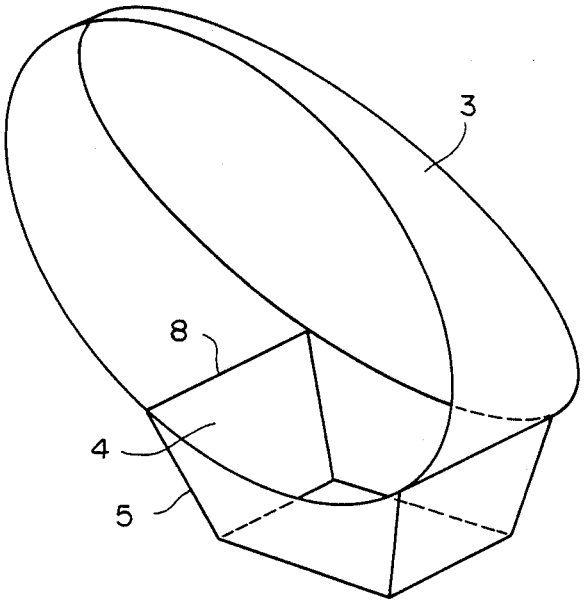
Fig. 3 (PRIOR ART)
FIG. 3 is a partial perspective view, of the offset antenna shown in FIG. 1.

On the other hand, when considering the matter from a mechanical viewpoint, each microportion of the side plate 13 is an elliptic conical shell and is continuous and smooth along the periphery, so that this shell is close to the shell of a Gaussian curvature of zero which is similar to the cylindrical shell of the side plate 13 (FIGS. 1 and 3) in the conventional apparatus. Therefore, the strength characteristics are also substantially the same. Since no hole is formed, unlike the conventional apparatus, the continuity of the shell is kept and the strength of the shell can be most effectively utilized so there is no need for reinforcement. Further, since the side plate 13 in this invention also functions as the box 5 (FIGS. 1, 2 and 3) in the conventional apparatus the box 5 itself is unnecessary and the number of parts is hence reduced. Furthermore, the wind current becomes smooth, so that the degree of wind load is not increased.

The side plate 13 can be numerically approximately expanded into a plane plate as mentioned above and can be manufactured by a sheet metal processing or a sheet forming process. Thus, the offset antenna can be made extremely cheaply.

In this way an offset antenna without any tendency to suffer from deterioration of its characteristics can be realized remarkably cheaply.

As described above, according to the invention, by forming the side plate of the offset antenna in a shape corresponding to an envelope body of predetermined cones, it is possible to obtain an effect whereby an inexpensive offset antenna which does not suffer from deterioration of its electrical and mechanical characteristics can be realized.

Figure 8:
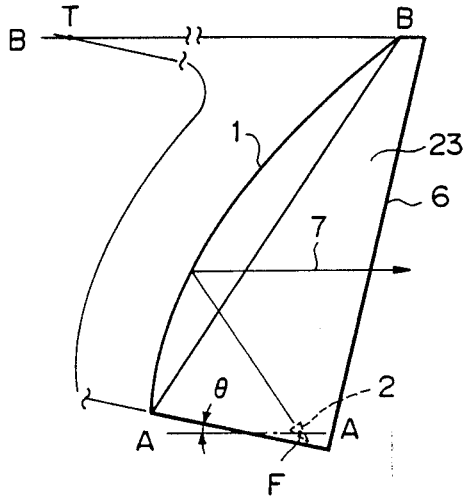
FIG. 8 is a side elevational view showing a second embodiment of an offset antenna according to the invention.
Figure 9:
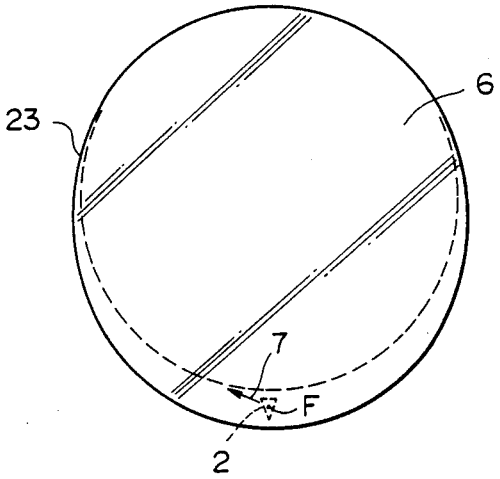
FIG. 9 is a front view of the offset antenna shown in FIG. 8.
Figure 10:
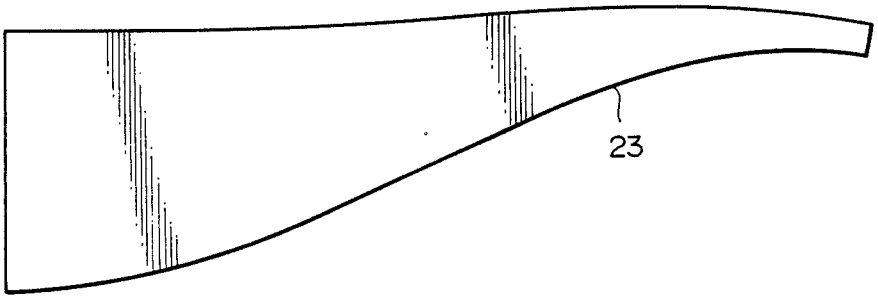
FIG. 10 is a developed view of half of a side plate 23.

Referring now to FIGS. 8, 9 and 10, a second embodiment of an offset antenna according to the invention is shown. The reflecting mirror 1, primary radiator 2, and radome 6 are the same as those in the first embodiment. A side plate 23 is formed so as to have its inner surface in the shape of a cone in which a vertex T is located on an axis B—B which passes through the farthest point on the outer periphery of the reflecting mirror 1 from the focal point F and is parallel to the rotary axis A—A of the reflecting mirror 1, the outer periphery of the reflecting mirror 1 being set to a generating line. The position of the vertex T is determined on the axis B—B by setting, for example, an angle $\theta$ in FIG. 0 to a desired value so that the primary radiator 2 is included in the cone, i.e., the inside of the side plate 23.

In the offset antenna constituted as mentioned above, the radio waves radiated from the primary radiator 2 to the reflecting mirror 1 are propagated along the transmission path 7 and form a sharp beam in the forward direction of the antenna in a manner similar to the conventional apparatus. However, the cone formed by the radio waves is included inside the side plate 23 and the hole and the edge formed by this hole that are present in the conventional apparatus are unnecessary. The side plate 23 does not interrupt or block the transmission path 7. Namely, the only edge acting to deteriorate the characteristics is the outer edge which is inevitable with an antenna, namely, the outer periphery of the reflecting mirror 1. The deterioration in side lobe due to the wave-like operation of the radio waves is hence minimized.

On the other hand, when considering the matter from the mechanical view point, the side plate 23 ordinarily constitutes an elliptic conical shell and is a shell of a Gaussian curvature of zero which is similar to the cylindrical shell of the side plate 3 (FIGS. 1 and 3) in the conventional apparatus, so that the strength characteristics are substantially the same. Since no hole is formed, unlike the conventional apparatus, the continuity of the shell is kept and the strength of the shell can be most effectively utilized, so there is no need for reinforcement. Moreover, since the side plate 23 in this invention is also used as the box 5 (FIGS. 1, 2 and 3) in the conventional apparatus, the box 5 is unnecessary and the number of parts is hence reduced. The wind current thus becomes smooth and there is no tendency for the wind load to be increased.

Since the side plate 23 constitutes a shell of a Gaussian curvature of zero as mentioned above, this curved surface can be expanded into a flat plate. The side plate 23 can be manufactured by a sheet forming process. Therefore, the offset antenna can be constituted extremely cheaply. An example of development (a half portion) of the side plate 23 is shown in FIG. 10.

In this way an offset antenna which suffer no deterioration of its characteristics can be realized remarkably cheaply.

As described above, according to the invention, by forming the side plate of the offset antenna in the shape of a predetermined cone, it is possible to obtain an effect whereby an inexpensive offset antenna without an tendency to suffer deterioration of its electrical and mechanical characteristics can be realized.

Figure 11:
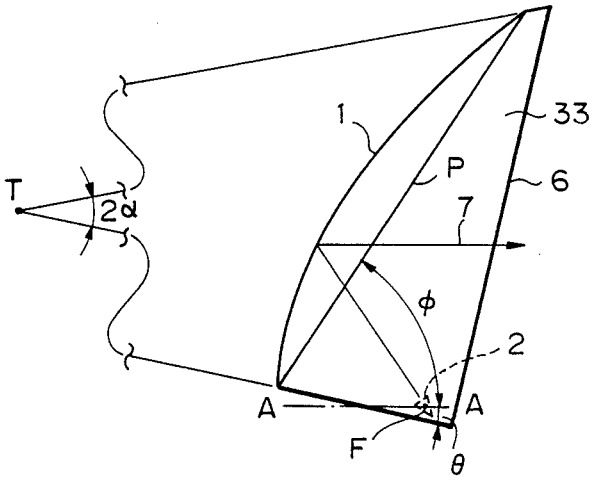
FIG. 11 is a side elevational view showing a third embodiment of an offset antenna according to the invention.
Figure 12:
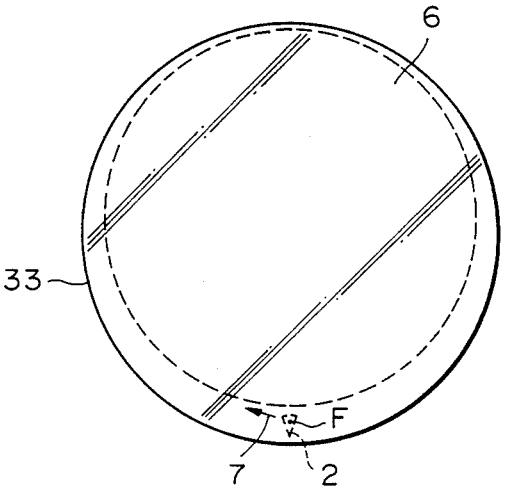
FIG. 12 is a front view of the offset antenna shown in FIG. 11.
Figure 13:
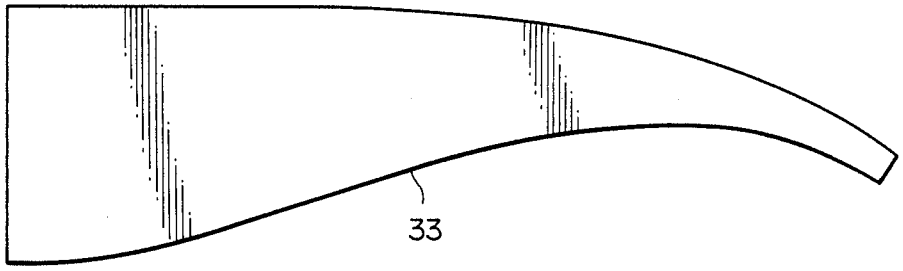
FIG. 13 is a developed view of half of a side plate 33.

Referring now to FIGS. 11 12 and 13, a third embodiment of an offset antenna according to the invention is shown. The reflecting mirror 1, primary radiator 2, and radome 6 are the same as those in the first embodiment. A side plate 33 is formed so as to have its inner surface in the shape of a cone in which a vertex T is located on a plane Q (in FIG. 11, a plane which is parallel to the paper surface and includes the focal point F) which is the symmetrical plane of the reflecting mirror 1, namely, vertical to the plane formed by the outer periphery of the reflecting mirror 1, i e., which is vertical to the plane P and includes the rotary axis A - A, and the outer periphery of the reflecting mirror 1 is used as a generating line. The angle $\theta$ between a generatrix on the side of the rotary axis A—A of the cone on the plane Q and the rotary axis A—A is determined in such a manner that the primary radiator 2 is included inside the cone, i.e., the inside of the side plate 33. At the same time, the angle $\theta$, a vertical angle $2\alpha$ (half-vertical angle L is $\alpha$) of the cone on the plane Q, and an angle $\phi$ between the plane P and the rotary axis A—A are set so as to satisfy the following relation.

$$\tan \alpha = \frac{\cos\phi - \cos(\phi + \theta)}{\sin(\phi + \theta)}$$

In the offset antenna constituted as described above, the radio waves radiated from the primary radiator 2 to the reflecting mirror 1 are propagated along the transmission path 7 and form a sharp beam in the forward direction of the antenna in a manner similar to the conventional apparatus. However, the cone formed by the radio waves is included within the side plate 33 and the hole and the edge formed by this hole which are present in the conventional apparatus are unnecessary. The side plate 33 does not interrupt or block the transmission path 7. Namely, the only edge acting to deteriorate the electrical characteristics is the outer edge which is inevitable with an antenna, namely, the outer periphery of the reflecting mirror 1. The deterioration in side lobe characteristics due to the wave-like operation of the radio waves is thus minimized.

On the other hand, when considering the matter from the mechanical view point, the side plate 33 constitutes the conical shell and is a shell of a Gaussian curvature of zero which is the same as the cylindrical shell of the side plate 3 (FIGS. 1 and 3) in the conventional apparatus. Therefore, the strength characteristics are almost the same. However, since no hole is formed, unlike the conventional apparatus, the continuity of the shell is maintained and the strength of the shell can be most effectively utilized so there is no need to provide reinforcement. Since the side plate 33 in this invention is also used in place of the box 5 (FIGS. 1, 2 and 3) in the conventional apparatus, the number of parts is reduced as the box 5 is unnecessary. Also, the wind current becomes smooth and the degree of wind load is thus kept down.

Further, as mentioned above, since the side plate 33 constitutes a shell of a Gaussian curvature of zero, this curved surface can be expanded into a flat plate. The side plate 33 can be manufactured by a sheet forming process, so that the offset antenna can be constituted extremely cheaply. There is an advantage in that even when a mold is manufactured by a manufacturing method other than a sheet forming process, for example, by a molding of a glass fiber reinforced plastic or the like, it can be properly produced by a general or non-specialized machine such as a vertical boring and turning mill or the like since the inner surface shape of the side plate is constituted by a cone. FIG. 13 shows an example of a developed shape (a half portion) in the case of manufacturing the side plate 33 by the sheet forming process.

As described above, according to the invention, by forming the side plate of the offset antenna in the shape of a predetermined cone, it is possible to obtain an effect whereby an inexpensive offset antenna without any tendency to suffer from deterioration of its electrical and mechanical characteristics can be realized.

Figure 4:
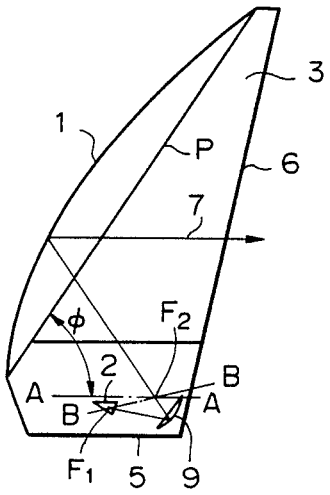
FIG. 4 is a side elevational view showing a second example of a conventional offset antenna
Figure 14:
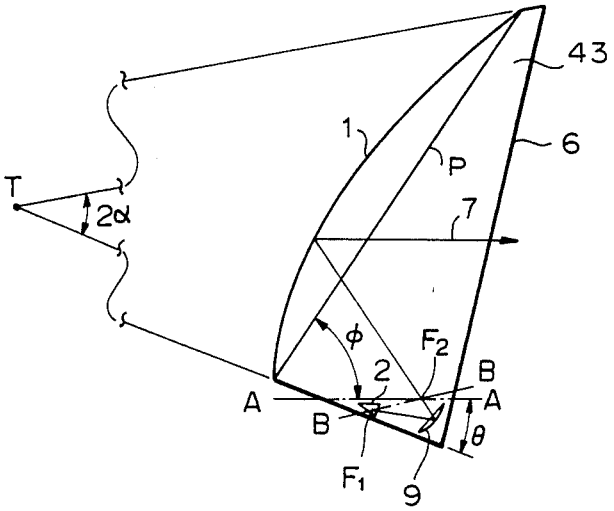
FIG. 14 is a side elevational view showing a fourth embodiment of an offset antenna according to the invention.
Figure 15:
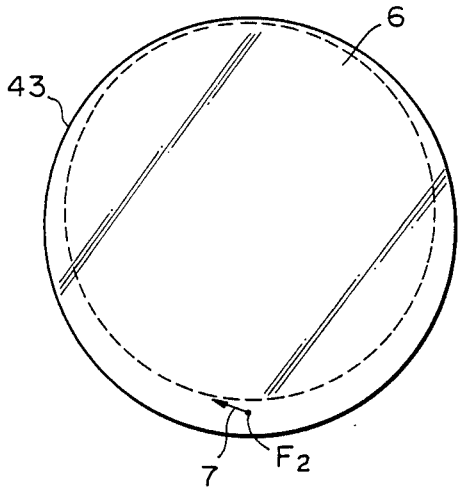
FIG. 15 is a front view of the offset antenna shown in FIG. 14.
Figure 16:
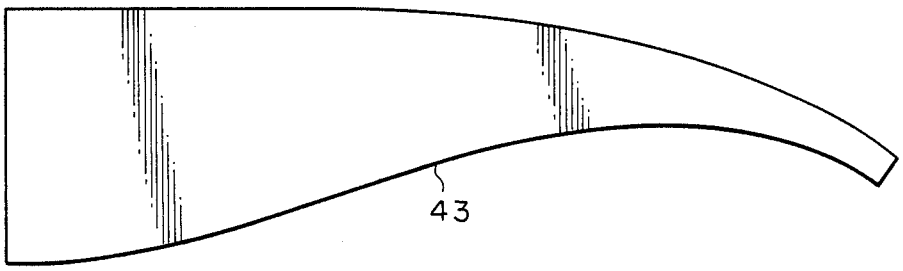
FIG. 16 is a developed view of half of a side plate 43.

Referring now to FIGS. 14, 15 and 16 in which a fourth embodiment of an offset antenna according to the invention is shown, the main reflecting mirror 1, sub-reflecting mirror 9, primary radiator 2 and radome 6 are similar to those in the conventional apparatus which has already been explained in conjunction with FIG. 4. A side plate 43 in the invention is formed so as to have its inner surface in the shape of a cone in which a vertex T is located on the plane Q (the plane which is parallel to the paper surface in FIG. 14 and includes a focal point $F_2$) which is vertical to the symmetrical plane of the main reflecting mirror 1, namely, to the plane formed by the outer periphery of the main reflecting mirror 1, i.e., which is vertical to the plane P and includes the rotary axis A—A, and the outer periphery of the main reflecting mirror 1 is used as a generating line. An angle $\theta$ between a generatrix on the side of the rotary axis A—A of the cone on the plane Q and the rotary axis A—A is determined in such a manner that the sub-reflecting mirror 9 and the primary radiator 2 are included within the cone, i.e., the inside of the side plate 43. At the same time, the angle $\theta$, the vertical angle $2\alpha$ (half-vertical angle is $\alpha$) of the cone on the plane Q, and an angle $\phi$ between the plane P and the rotary axis A—A are set so as to satisfy the following relation.

$$\tan \alpha = \frac{\cos\phi - \cos(\phi + \theta)}{\sin(\phi + \theta)}$$

In the offset antenna constituted as explained above, the radio waves radiated from the primary radiator 2 to the sub-reflecting mirror 9 and main reflecting mirror 1 ar propagated along the transmission path 7 and form a sharp beam in the forward direction of the antenna in a manner similar to the conventional apparatus. However, the cone formed by the radio waves is included within the side plate 43 and the hole and the edge formed by this hole which are present in the conventional apparatus are unnecessary. The side plate 43 does not separate or block the transmission path 7. Namely, the only edge acting to deteriorate the electrical characteristics is the outer edge which is inevitable with an antenna, namely, the outer peripheries of the main reflecting mirror 1 and sub-reflecting mirror 2. The deterioration in side lobe characteristics due to the wave-like operation of the radio wave is hence minimized.

On the other hand, when considering the matter from the mechanical viewpoint, the side plate 43 constitutes a conical shell and is a shell of a Gaussian curvature of zero which is similar to the cylindrical shell of the side plate 3 (FIG. 4) in the conventional apparatus. Therefore, the strength characteristics are substantially the same. However, since no hole is formed, unlike the conventional apparatus, the continuity of the shell is kept and the strength of the shell can be most effectively utilized, so there is no need to provide reinforcement. Since the side plate 43 in the invention is also used in place of the box (FIG. 4) in the conventional apparatus, the number of parts is reduced as the box 5 is unnecessary. The wind current becomes smooth as well, and the degree of wind load thus does not increase.

Further, as mentioned above, since the side plate 43 constitutes a shell of a Gaussian curvature of zero, this curved surface can be expanded into a flat plate. The side plate 43 can be manufactured by a sheet forming process. Thus, the offset antenna can be manufactured extremely cheaply. There is also an advantage in that even when a mold is manufactured by a manufacturing method other than a sheet forming process, for example, by molding a glass fiber reinforced plastic or the like, the side plate can be properly processed by a general machine or non-specialized machine such as a vertical boring and turning mill or the like since the inner surface shape of the side plate is a cone. FIG. 16 shows an example (a half portion) of a developed shape in the case of manufacturing the side plate 43 by a sheet forming process.

As described above, according to the invention, by forming the side plate of the offset antenna in the shape of a predetermined cone, it is possible to obtain an effect whereby an offset antenna without any tendency to suffer from deterioration of the electrical and mechanical characteristics can be cheaply realized.

What is claimed is:

1. An enclosure for an offset antenna having a reflecting mirror with a focal point and a smoothly-curved periphery and a primary electromagnetic wave radiator, said enclosure comprising:

a planar radome plate having a smoothly-curved periphery located adjacent said reflecting mirror and at an angle thereto so that electromagnetic waves having a phase center generated by said primary radiator and reflected from said reflecting mirror pass through said radome plate; and a smooth-curved non-cylindrical side wall connecting said reflecting mirror periphery to said radome plate periphery, said side wall forming a surface which is the outer envelope formed by an infinite series of elliptical cones, each of said cones having a vertex on said radome plate periphery and having said reflecting mirror periphery as a base.

2. An offset antenna enclosure according to claim 1 wherein said phase center of said electromagnetic waves generated at said primary radiator is substantially located at said reflecting mirror focal point.

3. An offset antenna enclosure according to claim 1 wherein a secondary reflector in the form of an ellipsoidal mirror is located substantially at said reflecting mirror focal point and electromagnetic waves generated by said primary radiator are reflected from said secondary radiator to said reflecting mirror.

4. An offset antenna enclosure according to either of claims 2 or 3 wherein said reflecting mirror is a paraboloid with an axis and said reflecting mirror periphery is a paraboloid section formed by cutting said paraboloid with a plane at an angle to said paraboloid axis.

5. An offset antenna enclosure according to claim 4 wherein said reflecting mirror periphery has a circular mirror projection on a plane perpendicular to said paraboloid axis, said mirror projection having a center and a radome plate projection of said radome plate periphery onto said plane has a circular shape congruent to said reflecting mirror projection on a first side of said center and has an elliptically-shaped portion on a second opposing side of said center, said elliptically-shaped portion having an axis.

6. An offset antenna enclosure according to claim 5 wherein said mirror projection has a radius of length r and said elliptically-shaped portion of said radome plate projection has a minor radius length equal to r and a major radius R longer than length r and wherein said paraboloid axis is located on the axis of said elliptically-shaped portion of said radome plate projection at a distance from said center which is greater than r, but less than R.

7. An offset antenna enclosure according to claim 6 wherein said primary radiator is located at the intersection of said paraboloid axis and said axis of said elliptically-shaped portion of said radome plate projection and between said reflecting mirror and said radome plate.

8. An enclosure for an offset antenna having a reflecting mirror in the shape of a paraboloid with an axis and a focal point with a smoothly-curved periphery corresponding to a paraboloid section formed by cutting said paraboloid with a plane at an angle to said paraboloid axis and a primary electromagnetic wave radiator located at said reflecting mirror focal point, said enclosure comprising:

a planar radome plate having a smoothly-curved periphery located adjacent said reflecting mirror and at an angle thereto so that electromagnetic waves reflected from said reflecting mirror pass through said radome plate; and a smoothly-curved side wall connecting said reflecting mirror periphery to said radome plate periphery, said side wall having a conical shape with a vertex located on a line parallel to said paraboloid axis which passes through the point of said reflecting mirror periphery located at the greatest distance from said reflecting mirror focal point, said vertex being located on said line on the side of said reflecting mirror opposite to said radome plate, said conical shape having a generator line passing through said vertex and points on said reflecting mirror periphery.

9. An offset antenna enclosure according to claim 8 wherein said generator line intersects said paraboloid axis at an angle wherein said angle is selected so that said primary radiator is located within said enclosure.

10. An enclosure for an offset antenna having a reflecting mirror in the shape of a paraboloid with an axis and a focal point with a smoothly-curved periphery corresponding to a paraboloid section formed by cutting said paraboloid with a plane at an angle $\phi$ to said paraboloid axis and a primary electromagnetic wave radiator, said enclosure comprising:

a planar radome plate having a smoothly-curved periphery located adjacent said reflecting mirror and at an angle thereto so that electromagnetic waves reflected from said reflecting mirror pass through said radome plate; and a smoothly-curved side wall connecting said reflecting mirror periphery to said radome plate periphery, said side wall having a conical shape with a vertex located on a plane which includes said paraboloid axis, said vertex being located on said line on the side of said reflecting mirror opposite to said radome plate, said conical shape having a generator line passing through said vertex and points on said reflecting mirror periphery, said generator line intersecting said paraboloid axis at angle $\theta$, wherein an included angle $2\alpha$ at said vertex satisfies the relation:

$$\tan \alpha = \frac{\cos\phi - \cos(\phi + \theta)}{\sin(\phi + \theta)}.$$

11. An enclosed offset antenna comprising:

a reflecting mirror with a focal point and a smoothly-curved periphery;

a primary electromagnetic wave radiator;

a planar radome plate having a smoothly-curved periphery located adjacent said reflecting mirror and at an angle thereto so that electromagnetic waves having a phase center generated by said primary radiator and reflected from said reflecting mirror pass through said radome plate; and a smoothly-curved non-cylindrical side wall connecting said reflecting mirror periphery to said radome plate periphery, said side wall forming a surface which is the outer envelope of an infinite series of elliptical cones, each of said cones having a point on said radome plate periphery as a vertex and said reflecting mirror periphery as a base.

12. An enclosed offset antenna according to claim 11 wherein said phase center of said electromagnetic waves generated at said primary radiator is substantially located at said reflecting mirror focal point.

13. An enclosed offset antenna according to claim 11 wherein a secondary reflector in the form of an ellipsoidal mirror is located substantially at said reflecting mirror focal point and electromagnetic waves generated by said primary radiator are reflected form said secondary radiator to said reflecting mirror.

14. An enclosed offset antenna according to either of claims 12 or 13 wherein said reflecting mirror is a paraboloid with an axis and said reflecting mirror periphery is a paraboloid section formed by cutting said paraboloid with a plane at an angle to said paraboloid axis.

15. An enclosed offset antenna according to claim 14 wherein said reflecting mirror periphery has a circular mirror projection on a plane perpendicular to said paraboloid axis, said mirror projection having a center and a radome plate projection of said radome plate periphery onto said plane has a circular shape congruent to said reflecting mirror projection on a first side of said center and has an elliptically-shaped portion on a second opposing side of said center, said elliptically-shaped portion having an axis.

16. An enclosed offset antenna according to claim 15 wherein said mirror projection has a radius of length r and said elliptically-shaped portion of said radome plate projection has a minor radius length equal to r and a major radius R longer than length r and wherein said paraboloid axis is located on the axis of said elliptically-shaped portion of said radome plate projection at a distance from said center which is greater than r, but less than R.

17. An enclosed offset antenna according to claim 16 wherein said primary radiator is located at the intersection of said paraboloid axis and said axis of said elliptically-shaped portion of said radome plate projection and between said reflecting mirror and said radome plate.

18. An enclosed offset antenna comprising a reflecting mirror in the shape of a paraboloid with an axis and a focal point with a smoothly-curved periphery corresponding to a paraboloid section formed by cutting said paraboloid with a plane at an angle $\phi$ to said paraboloid axis;

a primary electromagnetic wave radiator for generating electromagnetic waves;

a planar radome plate having a smoothly-curved periphery located adjacent said reflecting mirror and at an angle thereto so that electromagnetic waves reflected from said reflecting mirror pass through said radome plate; and a smoothly-curved side wall connecting said reflecting mirror periphery to said radome plate periphery, said side wall having a conical shape with a vertex located on a plane which includes said paraboloid axis, said vertex being located on said line on the side of said reflecting mirror opposite to said radome plate, said conical shape having a generator line passing through said vertex and points on said reflecting mirror periphery, said generator line intersecting said paraboloid axis at angle $\theta$, wherein an included angle $2\alpha$ at said vertex satisfies the relation:

$$\tan \alpha = \frac{\cos\phi - \cos(\phi + \theta)}{\sin(\phi + \theta)}.$$

* * * * *